United States Patent [19]

Frazier

[11] Patent Number: 4,540,505

[45] Date of Patent: Sep. 10, 1985

[54] DISINFECTANT SPRAY CLEANSER CONTAINING GLYCOL ETHERS

[75] Inventor: Charles Frazier, Kinnelon, N.J.

[73] Assignee: American Cyanamid Company, Stamford, Conn.

[21] Appl. No.: 296,759

[22] Filed: Aug. 27, 1981

Related U.S. Application Data

[63] Continuation-in-part of Ser. No. 266,265, May 22, 1981, abandoned, which is a continuation of Ser. No. 89,330, Oct. 30, 1979, abandoned, which is a continuation-in-part of Ser. No. 62,079, Jul. 30, 1979, abandoned.

[51] Int. Cl.[3] ..... C11D 1/62; C11D 3/44; C11D 7/50

[52] U.S. Cl. ..... 252/106; 252/153; 252/170; 252/171; 252/528; 252/547; 252/DIG. 14

[58] Field of Search ..... 252/106, 153, 528, 547, 252/DIG. 14; 106/15.05, 18.32, 18.35; 424/329

[56] References Cited

U.S. PATENT DOCUMENTS

| | | | |
|---|---|---|---|
| 3,023,144 | 2/1962 | Greathouse et al. | 252/106 X |
| 3,558,495 | 1/1971 | Mace | 252/90 |
| 3,666,668 | 5/1972 | Klausner | 252/90 |
| 3,694,365 | 9/1972 | Castner | 252/106 |
| 3,733,277 | 5/1973 | Wooden et al. | 252/106 |
| 3,882,038 | 5/1975 | Clayton et al. | 252/164 |
| 4,020,016 | 4/1977 | Sokol | 252/546 |
| 4,181,623 | 1/1980 | Dillarstone et al. | 252/143 |

FOREIGN PATENT DOCUMENTS

| | | |
|---|---|---|
| 2240287 | 4/1975 | France . |

OTHER PUBLICATIONS

Bennett, H., "The Chemical Formulary," vol. XV, The Chemical Publishing Co., N.Y., 1970, p. 185.

The Merck Index, Merck & Co., Inc., Ninth Edition, 1976, p. 718.

*Primary Examiner*—Prince E. Willis

*Attorney, Agent, or Firm*—William H. Calnan

[57] ABSTRACT

Germicidally effective, d-limonene-containing aqueous pump-spray compositions are rendered clear and stable by monoethers of certain aliphatic glycols which also enhance soil and stain removal from hard surfaces. The compositions also contain quaternary ammonium compounds, non-ionic surfactants, alkali builders and may contain lower aliphatic alcohols.

5 Claims, No Drawings

DISINFECTANT SPRAY CLEANSER CONTAINING GLYCOL ETHERS

This is a continuation-in-part of application Ser. No. 266,265, filed May 22, 1981, which in turn is a continuation of application Ser. No. 89,330, filed Oct. 30, 1979, which in turn is a continuation-in-part of application Ser. No. 62,079, filed July 30, 1979, all abandoned.

This invention relates to germicidally effective, aqueous pump-spray compositions. More particularly, it relates to such compositions which contain d-limonene and are clear and stable. Such clarity and stability is provided by monoethers of certain aliphatic glycols which also enhance soil and stain removal from hard surfaces The compositions of the invention comprise a germicidally effective quaternary ammonium compound, a nonionic surfactant, d-limonene, an alkali builder, a monoether of an aliphatic glycol, water, and, optionally, a lower aliphatic alcohol.

Cleansing agents containing a germicidally effective quaternary ammonium compound are also known (Pine Sol); see Pine Oil Formulary, Section B, Pine and Paper Chemicals Dept., Hercules, Inc., p. 13–42. Alkali builders are known to be used as cleansing boosters, particularly in detergents. Cleaning compositions containing d-limonene are also well-known. However, when even a small amount (about 0. 4% by weight) of d-limonene is introduced into a composition having the above-mentioned components, the composition is destabilized. In accordance with the present invention, it has been found that the addition of monoethers of certain aliphatic glycols to a composition comprising the foregoing components, including d-limonene, produces a clear solution which does not separate. Additionally, these monoethers enhance the soil and stain removal ability of the composition.

The ethers used in the composition of the present invention are those monoethers of aliphatic glycols which contain from 59 to 65%, by weight, carbon. When such glycol ethers contain less than 59% carbon, or more than 65% carbon, they are not compatible with the cleanser compositions, and clear, stable solutions do not result.

The quaternary ammonium compounds useable in the composition of the instant invention are those which are germicidally effective. Compounds which satisfy this requirement include alkyl dimethyl benzyl and alkyl dimethyl ethylbenzyl ammonium compounds wherein the alkyl group contains about 12 to 18 carbon atoms and dialkyl dimethyl ammonium compounds wherein the alkyl groups each contain about 8 to 10 carbon atoms. Obviously, mixtures of these compounds may also be used. Illustrative are, for example, a mixture of 50% n-alkyl ($C_{14}$–$C_{18}$) dimethyl benzyl ammonium chloride and 50% n-alkyl ($C_{12}$–$C_{18}$) dimethyl ethylbenzyl ammonium chloride (BTC 2125, a product of Onyx Chemical Co.), a mixture of 20 to 25% dioctyl dimethyl ammonium chloride, 25% didecyl dimethyl ammonium chloride, and 50% octyl decyl dimethyl ammonium chloride (Bardac 20, a product of Lonza, Inc.). It is believed, although Applicant does not wish to be bound by any theory, that the quaternary ammonium compound assists the ether in stabilizing the compositions of the present invention.

The non-ionic surfactant used in the composition of the present invention is an ethoxylated linear $C_{12}$–$C_{15}$ alcohol, containing from about 7 to 12 moles of condensed ethylene oxide, or an ethoxylated alkyl phenol containing from about 7 to 12 moles of condensed ethylene oxide. Preferably, the ethoxylated alcohol contains about 9 moles of condensed ethylene oxide, such as, for example, octylphenol ethoxylated with 9 moles of ethylene oxide. Mixtures of these non-ionic surfactants may also be used.

A suitable alkali builder, such as potassium carbonate, tetrapotassium pyrophosphate sodium metasilicate or the like, is used to enhance the cleansing ability of the composition.

Optionally, and to further enhance solubility, a lower aliphatic alcohol, such as ethanol or isopropanol, may be added. Similarly, a chelating agent may be used, such as tetrasodium ethylene diamine tetraacetate. A dye may also be added to color the composition.

The compositions typically will contain about 4 to 6% of the monoether of the aliphatic glycol; about 0.45–0.7% quaternary ammonium compound; about 0.4–1% d-limonene; about 1–1.5% nonionic surfactant; about 1% alkali builder; about 0–7% lower aliphatic alcohol; about 0–0.4% chelating agent; and water to a total of 100%.

The following examples, wherein all parts and percentages are by weight unless otherwise indicated, illustrate the invention:

EXAMPLE 1

| | Percentage |
|---|---|
| 1-Butoxyethoxy-2-propanol | 4.0 |
| BTC 2125* quaternary (50%) | 1.4 |
| Ethanol (95%) | 6.7 |
| Nonionic surfactant** (Neodol 25-9, Shell Chemical Company) | 1.3 |
| d-Limonene | 0.5 |
| Tetrasodium EDTA*** (40%) | 1.0 |
| Potassium carbonate | 1.0 |
| Dye (1% solution) | 0.06 |
| Water | qs to 100% |
| Appearance | Clear |
| % Carbon in glycol ether | 62.8 |

*50% n-alkyl ($C_{14}$–$C_{18}$) dimethyl benzyl ammonium chloride - 50% n-alkyl ($C_{12}$–$C_{18}$) dimethyl ethylbenzyl ammonium chloride
**Ethoxylated (9 moles ethylene oxide) linear aliphatic ($C_{12}$–$C_{15}$) alcohol
***Ethylenediamine tetraacetate

EXAMPLES 2–3

| | Percentage | |
|---|---|---|
| | 2 | 3 |
| Monobutyl ether of ethylene glycol | 6.0 | — |
| Monohexyl ether of ethylene glycol | — | 6.0 |
| BTC 2125 (50%) | 0.9 | 0.9 |
| Neodol 25-9 | 1.3 | 1.3 |
| d-Limonene | 0.4 | 0.4 |
| Sodium metasilicate | 1.0 | 1.0 |
| Water | qs to 100 | |
| Appearance | Clear | Cloudy |
| % Carbon in glycol ether | 61 | 65.75 |

EXAMPLES 4–6

| | Percentage | | |
|---|---|---|---|
| | 4 | 5 | 6 |
| Monoethyl ether of diethylene glycol | 4.0 | — | — |
| 1-Butoxyethoxy-2-propanol | — | 4.0 | — |
| Monomethyl ether of dipropylene glycol | — | — | 4.0 |

-continued

| | Percentage | | |
|---|---|---|---|
| | 4 | 5 | 6 |
| Ethanol (95%) | 6.7 | 6.7 | 6.7 |
| d-Limonene | 1.0 | 1.0 | 1.0 |
| BTC 2125 (50%) | 1.35 | 1.35 | 1.35 |
| Neodol 25-9 | 1.30 | 1.30 | 1.30 |
| UV Absorber | 0.06 | 0.06 | 0.06 |
| Potassium carbonate | 1.0 | 1.0 | 1.0 |
| Dye (1% soln.) | 0.24 | 0.24 | 0.24 |
| Water | | qs to 100 | |
| Appearance | Inc.* | Clear | Inc.* |
| % Carbon in glycol ether | 53.7 | 62.8 | 56.6 |

*Inc. - incompatible. The composition was not clear and stable in appearance.

EXAMPLES 7-9

| | Percentage | | |
|---|---|---|---|
| | 7 | 8 | 9 |
| Monobutyl ether of diethylene glycol | — | — | 4.0 |
| Monobutyl ether of ethylene glycol | 4.0 | — | — |
| Monoethyl ether of ethylene glycol | — | 4.0 | — |
| Ethanol (95%) | 6.7 | 6.7 | 6.7 |
| d-Limonene | 1.0 | 1.0 | 1.0 |
| BTC 2125 (50%) | 1.35 | 1.35 | 1.35 |
| Neodol 25-9 | 1.30 | 1.30 | 1.30 |
| UV Absorber | 0.06 | 0.06 | 0.06 |
| $Na_4EDTA$ (40%) | 1.0 | 1.0 | 1.0 |
| Potassium carbonate | 1.0 | 1.0 | 1.0 |
| Water | | qs to 100 | |
| Appearance | Clear | Inc.* | Clear |
| % Carbon in glycol ether | 61.0 | 53.3 | 59.3 |

*Inc. - incompatible. The composition was not clear and stable in appearance.

EXAMPLE 10

The composition of Example 1 is again prepared except that 1.3 percent of a 50% solution of Bardac 20, a mixture of 20 to 25% dioctyl dimethyl ammonium chloride, 25% didecyl dimethyl ammonium chloride and 50% octyl decyl dimethyl ammonium chloride, is substituted for the BTC 2125, and 1.2 percent of Neodol 25-7, an ethoxylated linear $C_{12}$–$C_{15}$ alcohol containing 7 moles of condensed ethylene oxide, is substituted for the Neodol 25-9. The composition is clear in appearance.

EXAMPLE 11

The composition of Example 10 is prepared except that 1.4 percent of an octylphenol ethoxylated with 9 moles of ethylene oxide is substituted for the Neodol 25-7. The composition is clear in appearance.

What is claimed is:

1. A clear, stable aqueous cleanser composition comprising about 0.45 to 0.7 percent of a germicidally effective quaternary ammonium compound; about 0.4 to 1 percent d-limonene; about 1 to 1.5 percent of a nonionic surfactant selected from an ethoxylated linear ($C_{12}$–$C_{15}$) alcohol and an ethoxylated alkyl phenol, containing about 7 to 12 moles of condensed ethylene oxide; about 1 percent of an alkali builder and about 4 to 6 percent of a monoether of an aliphatic glycol containing about 59 to 65 percent, by weight, carbon.

2. The composition of claim 1 wherein the quaternary ammonium compound is selected from the group consisting of alkyl dimethyl benzyl and alkyl dimethyl ethylbenzyl ammonium compounds wherein the alkyl group contains about 12 to 18 carbon atoms and dialkyl dimethyl ammonium compounds wherein each alkyl group contains about 8 to 10 carbon atoms.

3. A composition of claim 1 or claim 2 comprising about 0.45 to 0.7 percent of a mixture comprising about 50% $C_{14}$–$C_{18}$ alkyl dimethyl benzyl ammonium chloride and about 50% $C_{12}$–$C_{18}$ alkyl dimethyl ethyl benzyl ammonium chloride about 0.4 to 1 percent d-limonene; about 1 to 1.5 percent of an ethoxylated linear $C_{12}$–$C_{15}$ alcohol containing about 9 moles of condensed ethylene oxide; about 1 percent of an alkali builder selected from potassium carbonate and sodium metasilicate; and about 4 to 6 percent of a monoether of an aliphatic glycol selected from 1-butoxyethoxy-2-propanol, monobutyl ether of ethylene glycol and monobutyl ether of diethylene glycol.

4. The composition of claim 1, or claim 2 further comprising up to about 7 percent of a lower aliphatic alcohol.

5. The composition of claim 4 wherein the lower aliphatic alcohol is selected from ethanol and isopropanol.

* * * * *